US011039674B2

(12) United States Patent
Wang

(10) Patent No.: US 11,039,674 B2
(45) **Date of Patent: *Jun. 22, 2021**

(54) BREAKAGE RESISTANT LIGHT BULB HEADBAND

(71) Applicant: Connie Wang, Irvine, CA (US)

(72) Inventor: Connie Wang, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/748,984

(22) Filed: Jan. 22, 2020

(65) Prior Publication Data

US 2020/0170370 A1 Jun. 4, 2020

Related U.S. Application Data

(63) Continuation of application No. 16/205,650, filed on Nov. 30, 2018, now Pat. No. 10,561,217.

(51) Int. Cl.

| | |
|---|---|
| ***A45D 8/36*** | (2006.01) |
| ***F21V 23/02*** | (2006.01) |
| ***F21V 17/16*** | (2006.01) |
| ***F21V 23/00*** | (2015.01) |
| *F21W 121/06* | (2006.01) |
| *F21V 23/04* | (2006.01) |

(52) U.S. Cl.

CPC ..... *A45D 8/36* (2013.01); *F21V 17/16* (2013.01); *F21V 23/001* (2013.01); *F21V 23/023* (2013.01); *F21V 23/04* (2013.01); *F21W 2121/06* (2013.01)

(58) Field of Classification Search

CPC ..... A45D 8/36; F21V 17/16; F21V 23/001; F21V 23/023; F21V 23/04; F21W 2121/06

USPC ..... 362/105, 106

See application file for complete search history.

(56) References Cited

U.S. PATENT DOCUMENTS

2014/0268684 A1* 9/2014 Waters ..... F21V 21/084 362/106

* cited by examiner

*Primary Examiner* — Rajarshi Chakraborty
*Assistant Examiner* — Hana S Featherly
(74) *Attorney, Agent, or Firm* — Bacon & Thomas, PLLC

(57) ABSTRACT

A breakage resistant light bulb headband having increased flexibility includes a single piece injection-molded main body with integral bulb holding structures, a clip-on battery case, and wiring that connects light sources and a power source in the battery case by extending along an outside surface of the headband so as to eliminate the need for an internal passage, and a relatively thick multiple piece construction.

7 Claims, 9 Drawing Sheets

BREAKAGE RESISTANT LIGHT BULB HEADBAND

BACKGROUND OF THE INVENTION

1. Field of the Invention

The invention relates to a headband that supports multiple light bulbs and a battery compartment.

2. Description of Related Art

FIGS. 1-4 show a conventional light bulb headband 1. The light bulb headband 1 is intended to be positioned in a generally vertical orientation on a person's head, with each of the sides 2 extending downwardly against a side of the head between the person's cheeks and ears to hold the headband 1 in place. A central section 3 extends across the top of the head and includes four cylindrical light bulb cover supports 4, to which four decorative light bulb covers 5 are respectively attached.

Extending through the cylindrical light bulb cover supports 4 are wires 6 connected in parallel to four light sources 7, as shown in FIG. 3. Light sources 7 are situated in an interior of the light bulb covers 5 when the light bulb covers 5 are attached to the supports 4. The wires 6 pass from the supports 4 through a passage 8, shown in FIGS. 2 and 3, which is formed in the interior of the central headband section 3. The wires 6 extend through the passage 8 to an integrally-molded battery compartment 9, where they are electrically connected to a circuit board 10 on which are mounted and electrically connected a first battery terminal 11, a flasher circuit (not shown), and an on/off switch 13. A second battery terminal 12 in the form of a coil spring connected by a wire to the circuit board 10 is fixed to a sidewall of the battery compartment 9 to engage a first electrode of a disc battery (not shown) when the disc battery is positioned on the circuit board 10 so that a second electrode of the battery is in contact with the first battery terminal 11.

In order to provide access to the passage 8, the central section 3 is made up of a part 17 that is formed integrally with sides 2 of the headband 1, and a separate part 18 configured to be joined by screws (not shown) and corresponding internally threaded bosses 19 to part 17 in order to form the central section 3. When parts 17 and 18 are assembled together, the passage 8 is formed by a space between a top wall 15 and a bottom wall 16 of the central section 3 of the headband 1, with the supports 4 extending from the top wall 15. In addition, the supports 4 are made up of halves 4' and 4" integrally formed with respective parts 17 and 18.

Parts 17 and 18 may further include alignment pins and corresponding holes (not shown) to ensure that the parts are aligned before they are fastened together by screws 19. Although FIG. 3 shows the circuit board 10 positioned outside the battery compartment 9 for illustrative purposes, it is actually positioned inside the compartment 9 when the central section part 18 shown in FIG. 3 is assembled to the part 17 shown in FIG. 2. In addition, in the assembled position, the side of the circuit board 10 visible in FIG. 3 is flipped over to face the central section part 18, terminal, 12 and opening 20 through which the on/off switch 13 extends to allow the switch to be operated from outside the battery compartment 9. Switch 13 turns the headband on and off and, optionally, can be arranged to provide input to a circuit on the circuit board 10 that controls flashing, an/d or a flashing rate, of the light sources 7.

Because of the double-wall construction of the central section 3, and the integral nature of battery compartment 9, the central section 3 is substantially more rigid than the sides 2 of the headband. The rigidity results from the geometry of the central section 3, and is necessary to prevent damage to the circuit board 10. However, as shown in FIG. 4, this creates stress lines 20 at the joints between the flexible sides 2 and the rigid central section 3, resulting in areas where the headband is vulnerable to breakage.

In addition, the rigidity of the central section 3 has the effect of narrowing the range of head sizes onto which the headband 1 can be fitted, while the limited size of the central section 3 also limits the number of lights that can be supported by the central section. If the central section 3 were to be expanded around the sides of the headband to accommodate more lights, the headband would be even more difficult to fit, and would become increasing uncomfortable for the wearer.

SUMMARY OF THE INVENTION

It is accordingly an objective of the invention to provide a light bulb headband that is comfortable and fits a variety of head shapes and sizes.

It is a second objection of the invention to provide a light bulb headband that is durable and unlike to break.

It is a further objective of the invention to provide a light bulb headband that is capable of supporting a large number of light bulbs.

These objectives are achieved, in accordance with the principles of a preferred embodiment of the invention, by a light bulb headband having a single rather than multiple piece main body, and in which wires connecting the lights are routed along a top outside surface of the main body of the headband rather through a passage in a top central section of the headband. The term "top" refers to the location of the central section when the head band is worn on a user's head.

According to another feature of the preferred embodiment of the invention, the light bulb headband includes a battery compartment that is removable from the headband, and that is optionally located on a side of the headband. The removable compartment provides protection for the circuit board, space for multiple disc-shaped batteries or cells, and easy access to the battery or batteries without the need to disassemble the headband in order to change batteries.

According to yet another feature of the preferred embodiment of the invention, the light bulbs are arranged not only on a top of the headband, but also on portions of the downwardly extending sides of the headband, thereby increasing a number of light bulbs that can be provided on the headband.

Because the main body is made of a single piece, it can be made in an injection molding process without the having to screw together multiple pieces. Further, by running the wires on an exterior surface of the headband, the light bulbs and battery compartment can be pre-wired together and snapped into place, without having to position and hold the wires and light sources while assembling the separate parts of the headband, simplifying the assembly procedure and reducing assembly costs.

Finally, because the entire headband is flexible, it can conform to a greater variety of head shapes and sizes, resulting in increased comfort despite the increased resistance to breakage resulting from the elimination of rigid/ flexible section stress lines, and the ability to support greater number and variety of light bulbs.

DETAILED DESCRIPTION OF THE PREFERRED EMBODIMENTS

As illustrated in FIGS. 5A, 5B, 5C, 6, and 7, a light bulb headband constructed in accordance with the principles of a preferred embodiment of the invention includes a single piece main body 30 made, for example, by injection molding. Main body 30 has the shape of a conventional non-illuminated headband that does not include light bulbs, and that is instead designed simply to hold a wearer's hair in place, except that the main body 30 of the preferred embodiment has a plurality of projecting light-bulb holding structures 31 (shown in FIGS. 6 and 7) that serve to hold light bulbs in place, and a section 32 having reduced thickness and width onto which a battery case 33 is clipped. Except for section 32, the main body 30 has a uniform thickness and flexibility.

Figure 6:
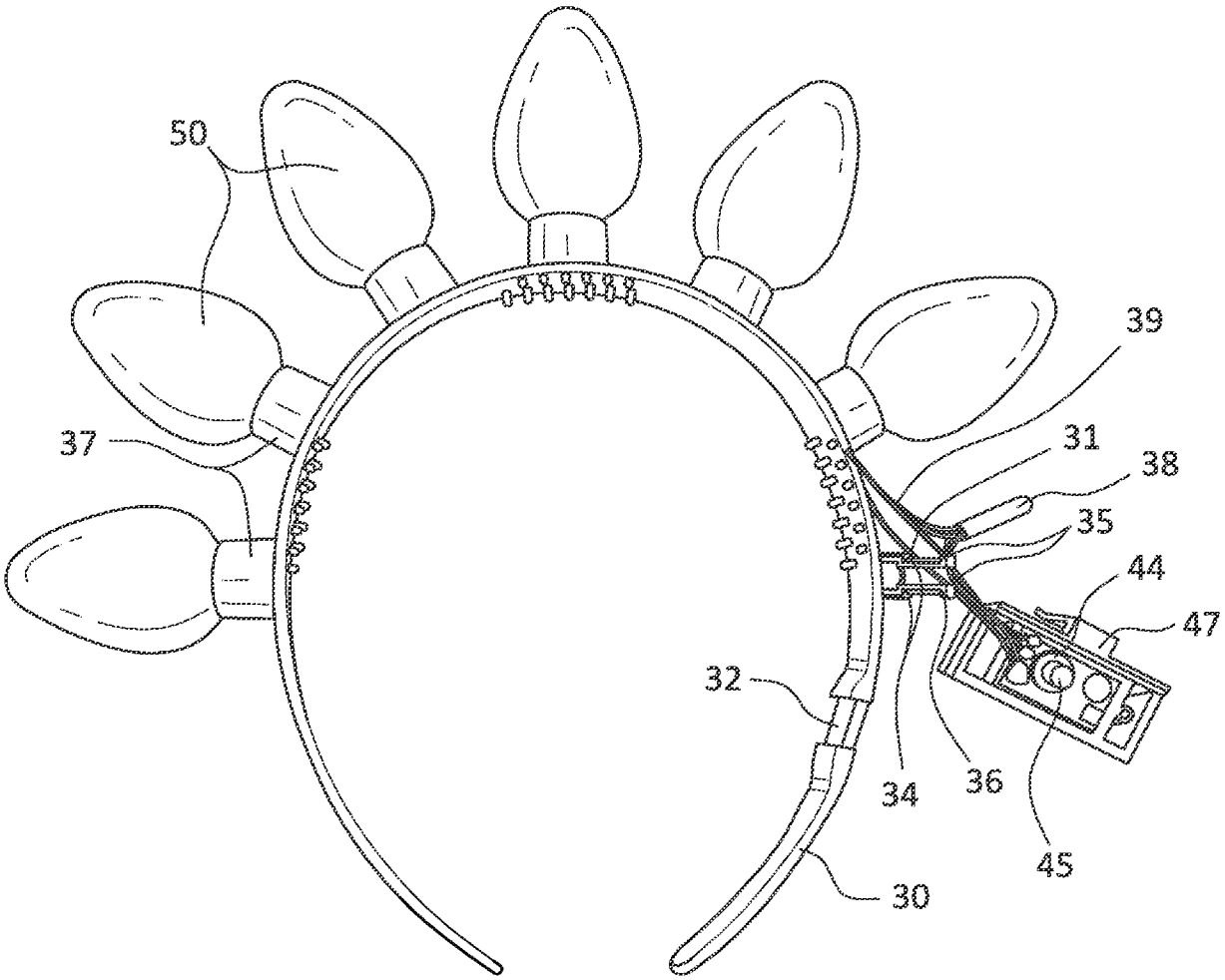
FIG. 6 is a front view of the headband of FIGS. 5A-5C, with battery case and one of the light bulbs removed
Figure 7:
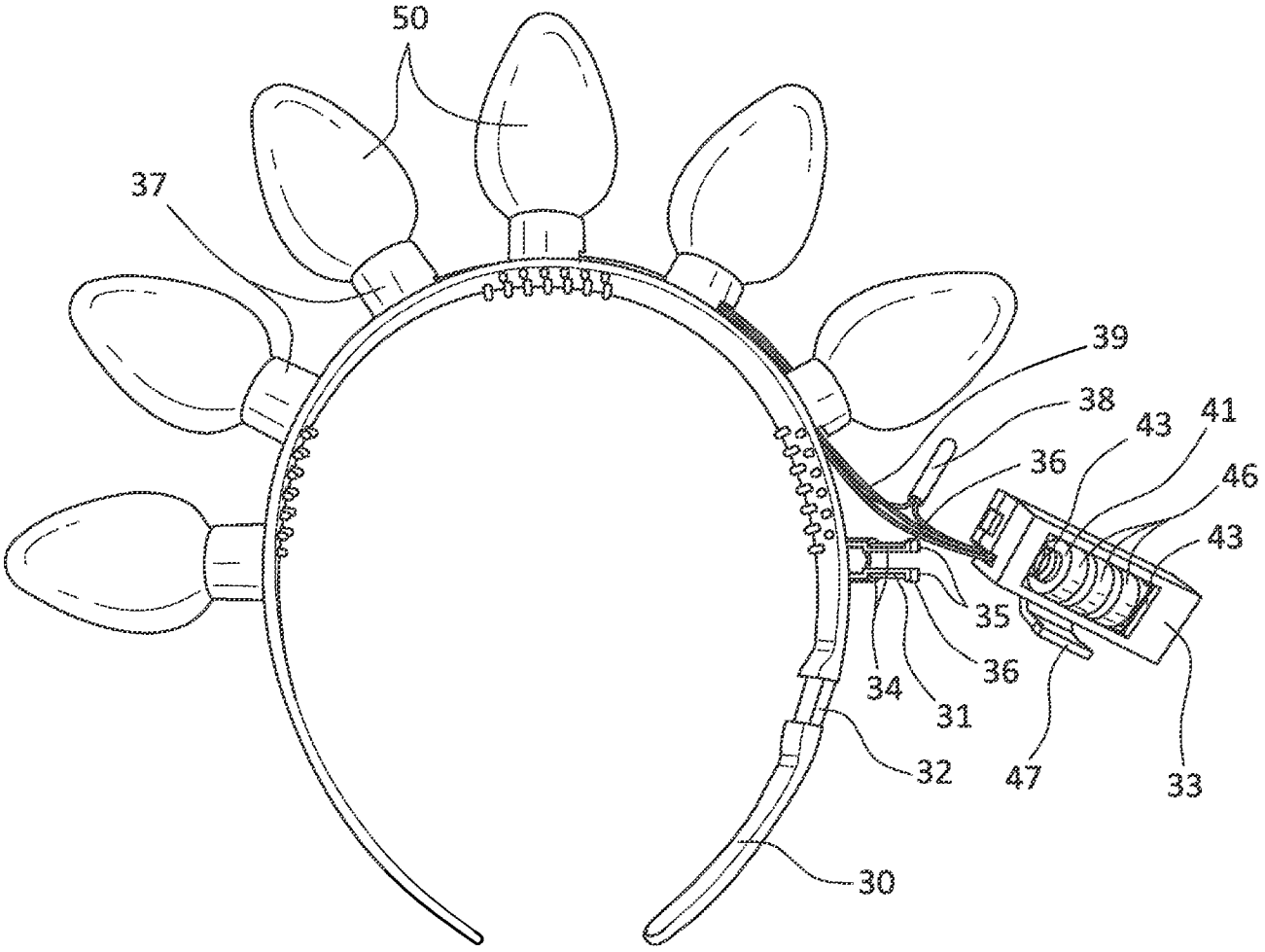
FIG. 7 is a front view of the headband of FIGS. 5A-5C, showing the opposite side of the battery case.

As illustrated in FIGS. 6 and 7, the light bulb holding structures are made up of inwardly flexible prongs 34 integrally molded with the main body body 31 and having latch hooks 35 at distal ends. The latch hooks include a top cam surface 36 that causes the prongs 34 to bend inwardly as they are inserted into a cylindrical base of a light bulb 37 until the hooks are inserted far enough into the bulb to clear the cylindrical base 37 and latch onto a surface within the bulb to latch the bulb onto the headband after a light source 38 is positioned between the prongs 34 so that the light emitting top portion of the light source extends into the interior of the bulb 37.

Although the illustrated embodiment includes latching structures that extend from and are molded into the headband main body 31, it will be appreciated that the prongs 34 may may be replaced by structures that extend from the base of the bulb, or a bulb cover, so as to latch onto cylindrical structures extending from the headband, in a manner similar to the arrangement shown in FIGS. 1-4. The shape and manner in which the bulbs 50 are latched onto the headband may therefore be varied in a variety of ways without departing from the scope of the invention.

Figure 1:
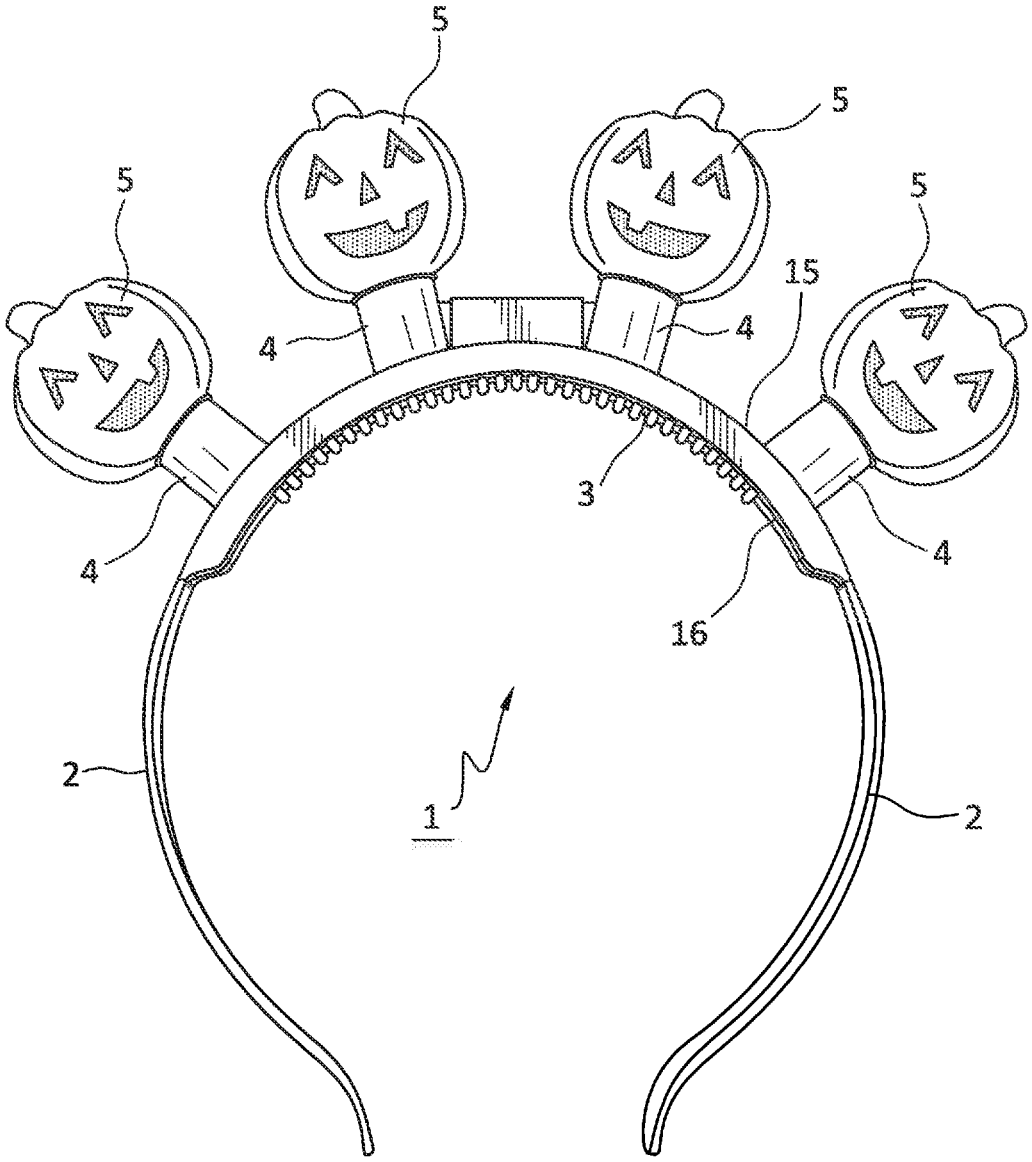
FIG. 1 Prior Art
FIG. 1 is a front view of a conventional light bulb headband.
Figure 2:
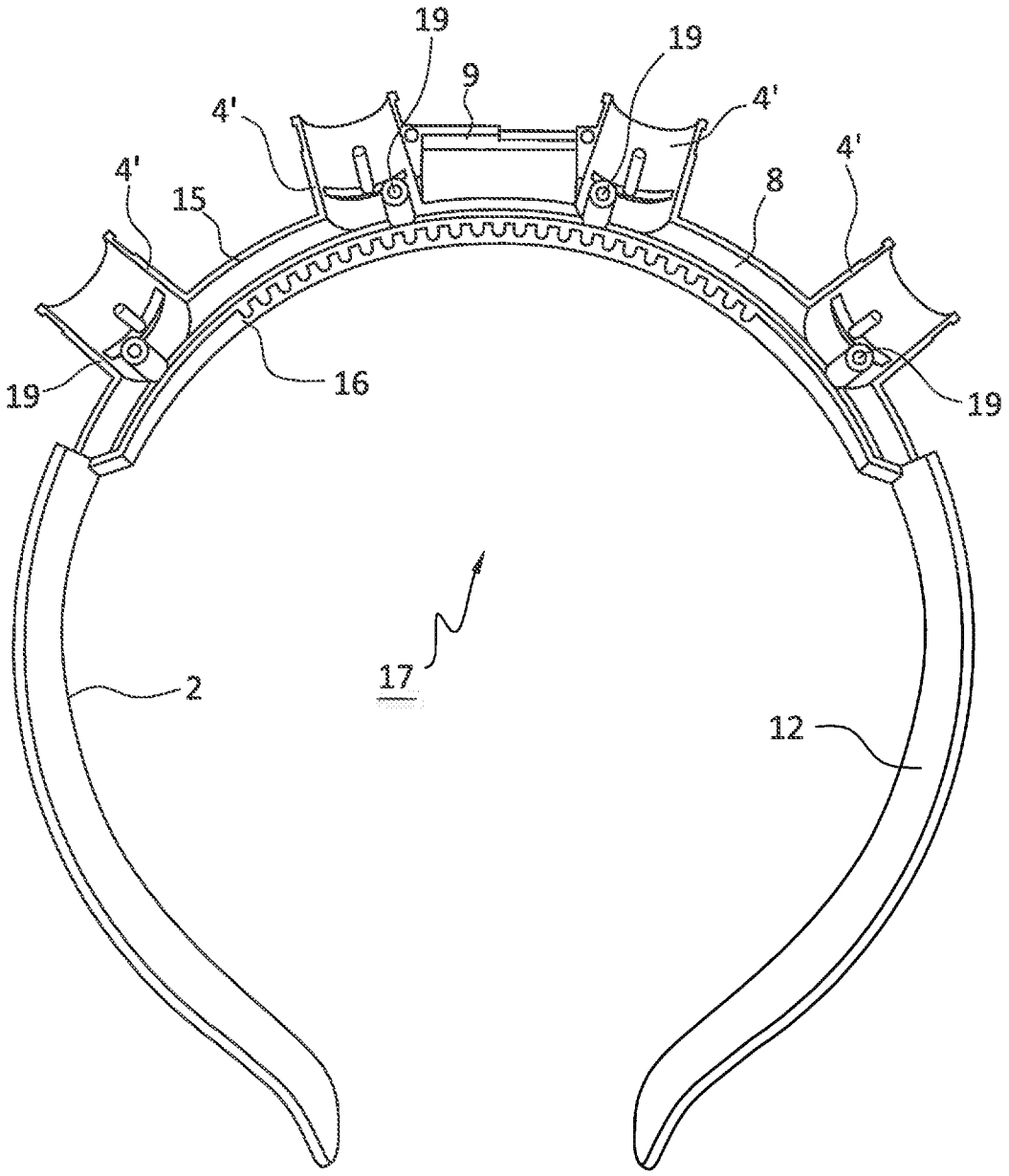
FIG. 2 Prior Art
FIG. 2 is a front view of the conventional light bulb headband of FIG. 1, after removal of one of the pieces that make up the central section of the conventional headband.
Figure 3:
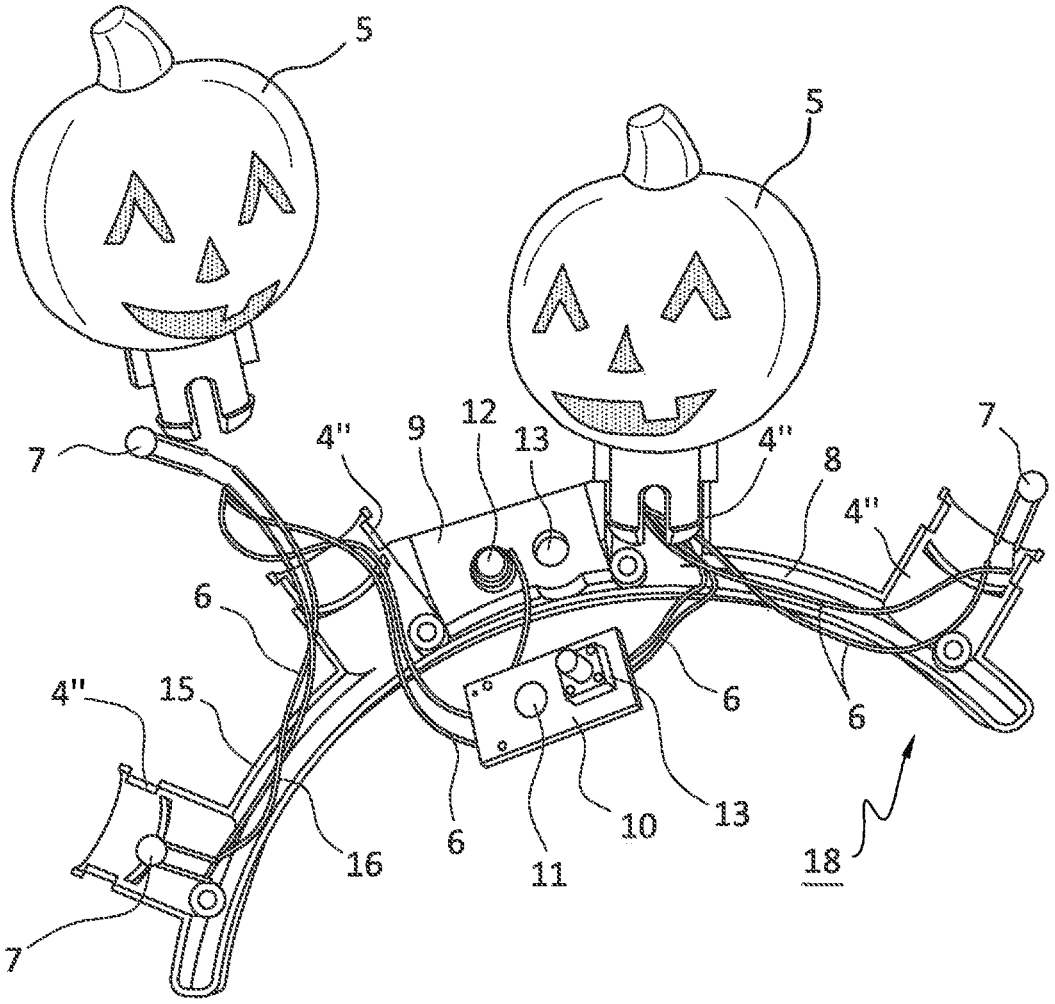
FIG. 3 Prior Art
FIG. 3 is a rear view of the removed piece of the central section of the conventional headband.
Figure 4:
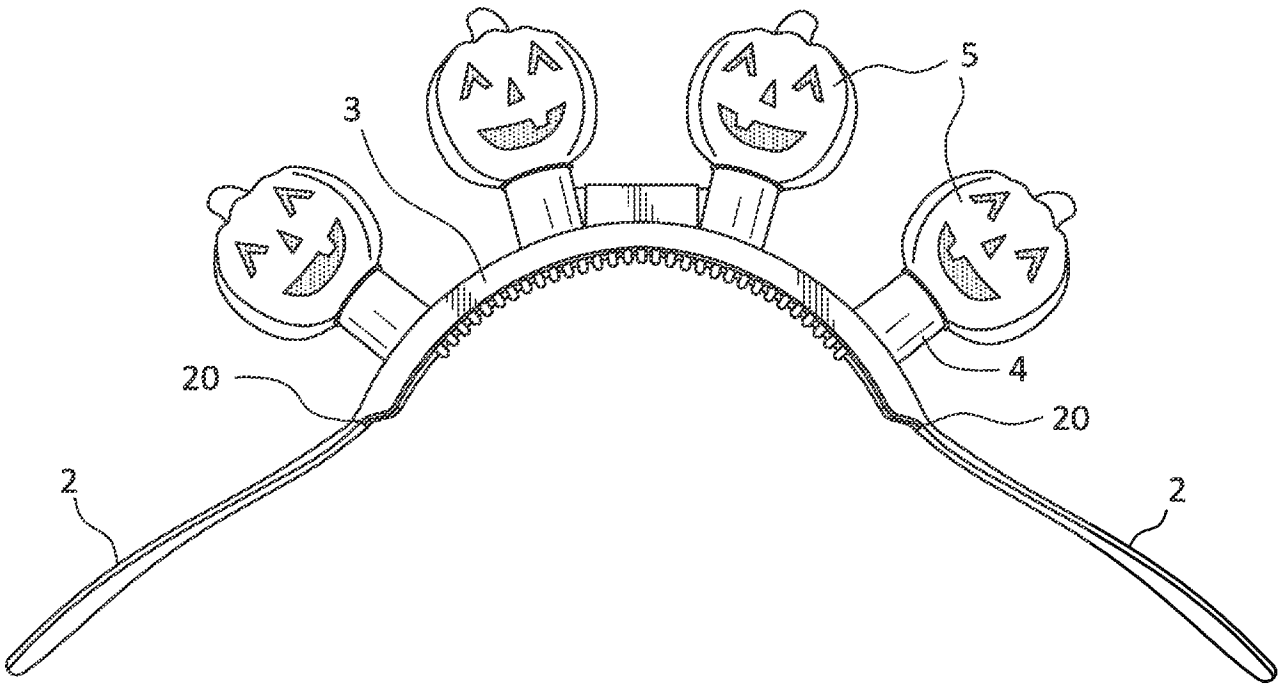
FIG. 4 Prior Art
FIG. 4 is a front view of the headband of FIGS. 1-3, illustrated in an over-stressed condition.
Figure 5A:
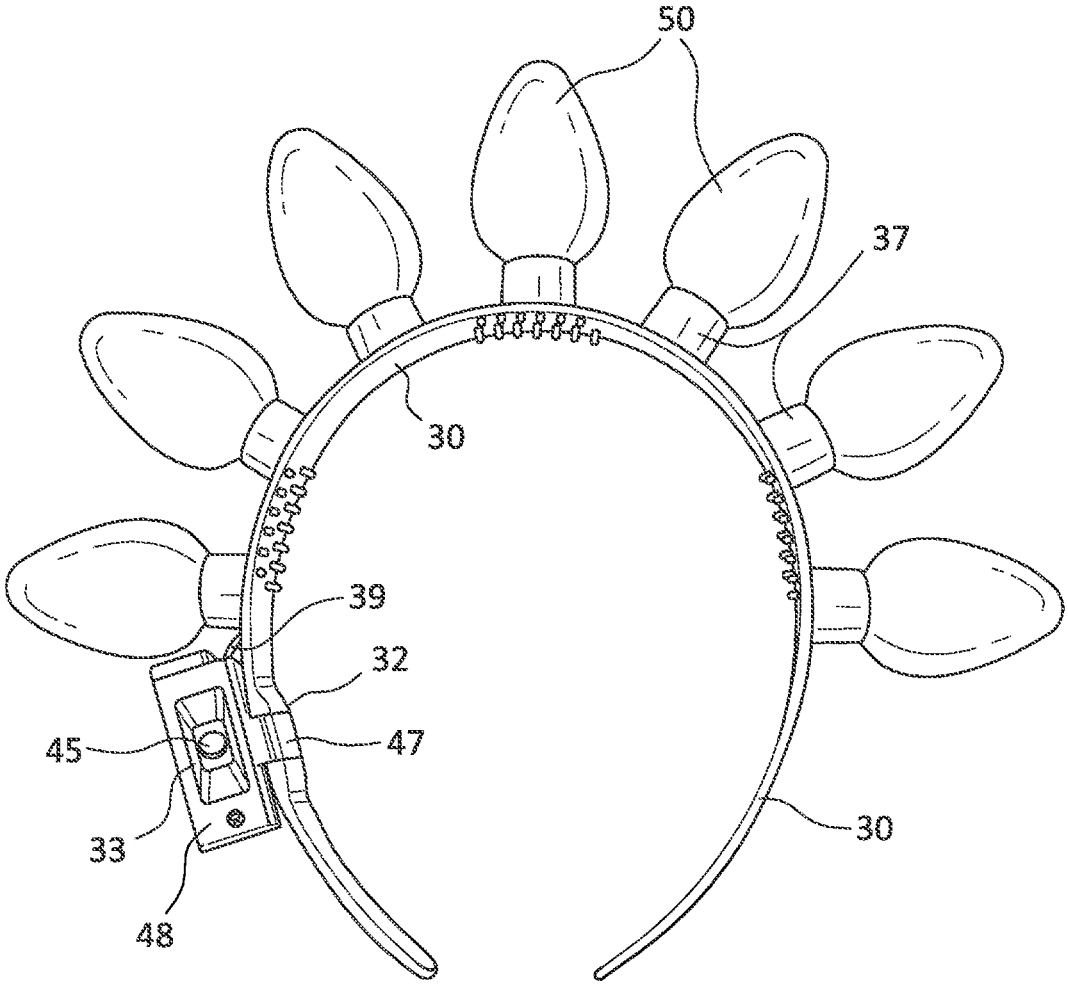
FIGS. 5A and 5B are front views of a light bulb headband constructed in accordance with the principles of a preferred embodiment of the present invention, with FIG. 5A show in the headband in an unflexed state and FIG. 5B showing the headband in a flexed state.
Figure 5B:
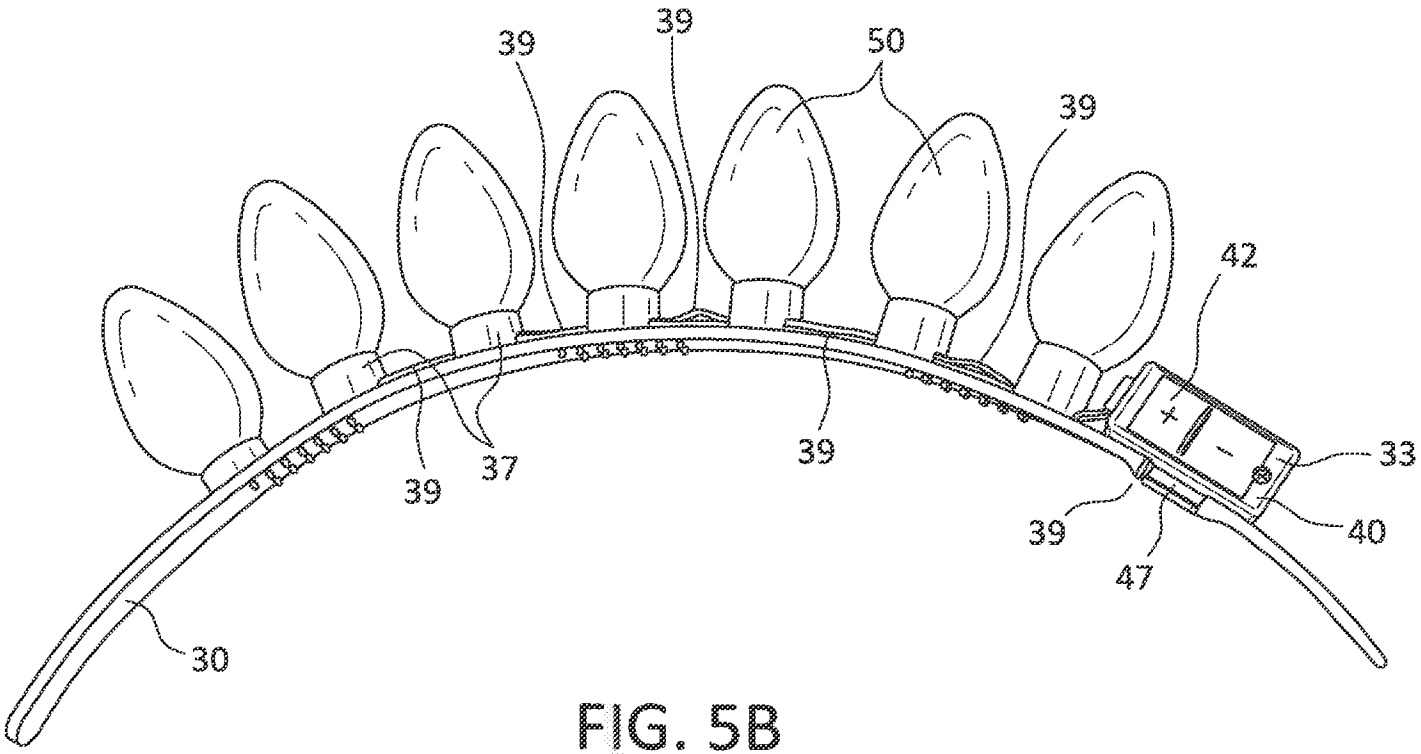
Figure 5C:
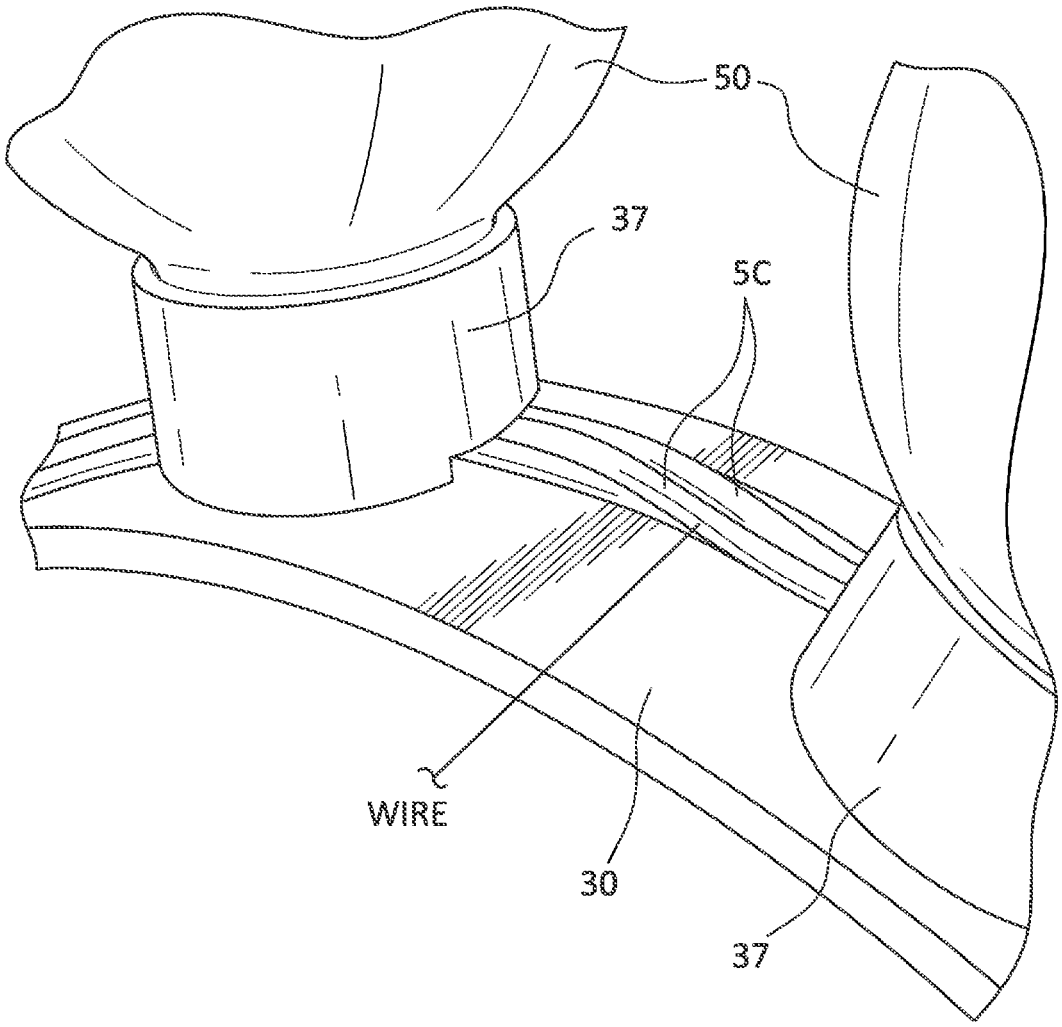
FIG. 5C is a close-up perspective view of the top of the headband of FIGS. 5A and 5B.

Preferably, in the illustrated embodiment, at least two notches are formed in the cylindrical base 37 of each bulb 50, at a point where the bulb base contacts the headband, or in each bulb-holding structure extending from the main body 31, so as to permit passage into the respective bulb bases 37 of wires 39 connecting the light sources 38 and batteries included in the battery case 33. The wires 39 extend along the top surface of the main body 31, as best seen in FIGS. 5B and 5C, without the need for an internal passage, in order to connect the light sources and battery in parallel.

The battery case 33 includes a rigid housing 40 containing a battery compartment 41 (shown in FIG. 7), a battery compartment cover 42, terminals 43 on opposite ends of the battery compartment, a circuit board 44 situated in a space below the battery compartment 41 that is separated from the battery compartment 41 by a divider wall (not shown) and that is accessible from the opposite side of the battery case from the side on which battery compartment cover 42 is placed. An on/off switch 45 is mounted on the circuit board 44 and positioned to extend through an opening in a cover 48 (shown in FIG. 5A) that is screwed onto the case 33 on the side opposite battery compartment cover 42, after positioning of the circuit board 44. The battery compartment 41 includes space for, by way of example, three button cells 46 that may be stacked and positioned between the terminals 43 so as to provide a series-connected power source accessible by the user through the battery compartment cover 42 when the battery case 33 has been removed from the headband main body 31.

Removable attachment of the battery case to the headband main body 31 is by a clip 47 that fits over the reduced-thickness-and-width section 32 to clip the battery case 33 onto the main body 31. The configuration of the clip 47 may be varied without departing from the scope of the invention, for example by integrating the clip into the headband main body 31 rather than battery case, and providing a clip-receiving mating structure on the battery case 33. In addition, it will be appreciated that the illustrated button cell battery configuration may be replaced by other power power source configurations including, for example, a compartment adapted to receive batteries other than button or disc-shaped cells.

Although the illustrated embodiment includes Christmas tree shaped bulbs, which may come in a variety of colors, it will be appreciated that the shapes and sizes of the bulbs or bulb covers may be freely varied, including shapes appropriate for holidays other than Christmas such as the jack-o-lantern shaped bulb covers illustrated in FIGS. 1-4, star shapes, candy corn shapes, and any other shape of bulb that a consumer might want to wear on his or her head. In addition, the headband of the preferred embodiment may be varied to include additional decorative or ornamental features, such as reindeer antlers.

Accordingly, it is to be understood that the above embodiments are intended to illustrate the principles of the invention, and that the scope of the invention is defined by the appended claims. Variations and modifications of the preferred embodiments may be made without departing from the scope of the invention.

What is claimed is:

1. A light bulb headband, comprising:

a main body, the main body fitting over a head of a wearer;

a plurality of bulb holders extending from the main body, the plurality of bulb holders receiving and holding light bulb covers;

a plurality of light sources, the plurality of light sources extending into the light bulb covers when the light bulb covers are held by respective ones of the bulb holders;

a battery case; and wires connecting the plurality of light sources with a power source in the battery case, wherein the wires extend from the battery case along an outside surface of the main body and into spaces within the bulb holders for connection to the light sources.

2. A light bulb headband as claimed in claim 1, wherein the plurality of bulb holders including prongs integral with and extending from the head band to latch onto and respectively hold the light bulb covers.

3. A light bulb headband as claimed in claim 1, wherein the battery case is removably secured to the main body.

4. A light bulb headband as claimed in claim 3, wherein the battery case is removably attached to the main body by a clip.

5. A light bulb headband as claimed in claim 4, wherein the clip fits over a section of the main body having a reduced thickness and width.

6. A light bulb headband as claimed in claim 1, wherein the battery case houses a circuit board, battery terminals, a battery compartment, and on/off switch, and at least one removable battery, and wherein the at least one removable battery is accessible to a user through a battery compartment cover.

7. A light bulb headband as claimed in claim 1, wherein the main body is an injection molded single piece main body.

* * * * *